United States Patent [19]

Dozier

[11] 4,442,770

[45] Apr. 17, 1984

[54] PUSHROD FOR HIGH SPEED

[75] Inventor: Hilliard Dozier, Morrow, Ohio

[73] Assignee: U.S. Terminals, Inc., Cincinnati, Ohio

[21] Appl. No.: 370,362

[22] Filed: Apr. 21, 1982

[51] Int. Cl.[3] ..... B41J 9/26

[52] U.S. Cl. ..... 101/93.32; 101/93.48

[58] Field of Search ..... 101/93.02, 93.09, 93.29, 101/93.31–93.34, 93.48; 173/128–133; 16/49, 82, 85

[56] References Cited

U.S. PATENT DOCUMENTS

| | | | |
|---|---|---|---|
| 952,511 | 3/1910 | Chambre | 16/85 |
| 1,053,093 | 2/1913 | Gilman | 173/133 |
| 1,126,836 | 2/1915 | Newton | 16/85 |
| 1,211,480 | 1/1917 | Newton | 16/85 |
| 1,365,857 | 1/1921 | Seder | 173/132 |
| 2,074,008 | 3/1937 | Wolf | 16/85 |
| 2,099,246 | 11/1937 | Raffles | 173/131 |
| 2,208,730 | 7/1940 | Pfeiffer | 173/133 |
| 2,519,435 | 8/1950 | Byrd, Jr. | 16/82 X |
| 3,433,153 | 3/1969 | Harrington et al. | 101/93.09 |
| 3,715,978 | 2/1973 | Raider | 101/93.09 |

OTHER PUBLICATIONS

IBM Technical Disclosure Bulletin by Lansing et al., vol. 23, No. 8, Jan. 1981, pp. 3644–3645.

*Primary Examiner*—Edgar S. Burr
*Assistant Examiner*—John A. Weresh
*Attorney, Agent, or Firm*—Frost & Jacobs

[57] ABSTRACT

An improved pushrod for an impact printer or the like wherein the pushrod wire has a tip member at each end thereof, the outer ends of the tip members having a seat-forming, preferably conical, recess therein communicating with an underlying undercut cavity, a molded impact button being seated in the recess and filling the undercut cavity, the impact button having an outwardly projecting surface which is preferably flat. In a preferred embodiment the axial bore in the shank of the tip member communicates with the annular cavity and the undersurface of the impact button has a centrally disposed recess therein. The shanks of the tip members are preferably swaged to the pushrod wires at three or more angularly equal locations about the periphery of the shanks, the ends of the pushrod wires being roughened by grit blasting.

12 Claims, 6 Drawing Figures

PUSHROD FOR HIGH SPEED

This invention relates to impact printers of the type used with computers to provide print-outs, and relates more particularly to an improved construction for the pushrods utilized in such printers to actuate the impact hammers which cause the various characters to be printed.

BACKGROUND OF THE INVENTION

High speed band type computer impact printers utilize as many as 150 pushrods each adapted to actuate an impact hammer. These pushrods operate at up to 50 impacts per second and at operating temperatures up to 190° F. The type of pushrods currently in use is shown in FIG. 1 and designated "Prior Art". It comprises an elongated pushrod wire 1 having a tip member 2 at each end thereof, the tip members usually being of identical configuration. Each pushrod tip comprises a body 3 having a shallow cup-shaped recess 4 formed in its outer face, the body terminating at its opposite face in a cylindrical shank 5 having a blind bore 6 extending inwardly from the distal end of the shank, the bore terminating short of the cup-shaped recess 4. Recess 4 is filled with an elastomeric material which forms a relatively shallow impact button 7. The impact buttons have heretofore been formed by placing a drop of a liquid elastomer in the recess 4 and permitting it to cure in situ, the elastomer being admixed with a curing agent. The contour of the exposed portion of the impact button is determined by the surface tension of the elastomer, such contour being of essentially semi-hemispherical shape, as indicated at 8. The tip members 2 are fixed to the wire 1 by inserting the opposite ends of the wire into the bores 6 of the tip members and swaging the shanks 5 to the wire, the ends of the wires being first roughened by means of a knurling tool. The current practice is to swage the opposite sides of the shank 5 so as to compress the shank so that it has a somewhat eliptical shaped cross-section.

While pushrods of the types described have been successfully used, they are subject to failure and are expensive to manufacture due to their configuration and the manner in which the impact buttons are formed. Failures occur due to the fact that the tip members lose their impact buttons which are secured to the tip members solely by the adhesive bond between the elastomeric material and the shallow recess in the tip member. It also may be noted that the adhesion of the elastomeric material to the tip members requires elaborate surface preparation of the tip members prior to application of the elastomer. Since the shape of the external surface of the impact buttons is primarily determined by the free surface tension of the elastomeric material from which they are formed, the tip profile is essentially semi-hemispherical and the initial impact area of the buttons is quite small and immediate movement and compliance of the elastomer is necessary during initial use, resulting in some degree of permanent set of the elastomer. During the initial burn-in period of the printers it becomes necessary to compensate for this set in the elastomer resulting from applied impact forces. Due to the configuration of the prior art impact buttons, the impact force deformation of the elastomer is inherently directed radially outwardly which, coupled with the relatively shallow configuration of the recesses, results in high unit impact stresses within the impact buttons and they are more readily susceptible to permanent deformation under load.

Another problem encountered with presently known pushrods is their tendency to fail by fracture and breakage of the pushrod wires, generally in the areas immediately adjacent the cylindrical shanks 5. Breakage of the pushrod wires is believed to be due in part to the configuration of the impact buttons and the manner in which they transmit the impact forces to the wire rods. Wire breakage also may be caused by the manner in which the shanks of the tip members are swaged to the wire, the customary procedure being to employ an opposing pair of staking members which form the opposite sides of the shanks. Staking in this manner has a tendency to cause directional deflection of the tip members in use and loss of concentricity with respect to the pushrod wires.

The present invention overcomes the inherent deficiencies in presently used pushrods by providing a pushrod construction in which the configuration of the impact buttons and the manner in which they are secured to the pushrod tips effectively prevents the loss of the impact buttons as well as undesirable deformation of the buttons and the resultant severity of the impact forces transmitted to the pushrod wires.

SUMMARY OF THE INVENTION

In accordance with the present invention, the pushrod tip members are configured so that upon the molding of the impact buttons to the tip members, the buttons will interlock with the tip members and hence become captive without the necessity for adhesives or staking.

The exposed portions of the impact buttons are configured to incorporate a flat surface at their outermost ends so that the first point of impact is of substantial area, the flat surface of the button preferably having a diameter which is from about 30 to 40% of the maximum diameter of the exposed portion of the impact button. Such arrangement acts to reduce the immediate unit stress upon impact of the hammer or the like with the button.

It is also preferred to provide the tip members with conical seats for receiving the impact buttons, the conical seat having a maximum diameter which is approximately equal to the maximum diameter of the exposed portion of the buttons. The conical seats open inwardly in enlarged, undercut cavities which terminate inwardly at the interface of the cavities with the bores in the shanks of the tip members, the tip members thus having through bores in communication with the conical seats and the underlying annular cavities. Such arrangement facilitates the fabrication of the tip members and also the in situ molding of the impact buttons, including the insertion of a mandrel pin during the molding operation which is configured to provide a centrally disposed recess or dimple in the undersurface or base of each impact button, such dimple serving to permit elastic flow of the elastomeric material from which the impact buttons are formed toward the centerlines of the pushrod wires. The impact forces are thus transmitted through and elastically deform the impact buttons, with the conical seats and the dimples serving to guide and direct the applied forces and elastic deformation toward the centerline of the pushrods rather than radially outwardly as in the case of the prior art.

The invention also contemplates an improved technique for swaging the shanks of the tip members to the pushrod wires so as to maintain the tip members concentric with the pushrod wires during the staking operation and also prevent the impact forces from causing the swaged tip members to deflect more frequently in any one direction.

DESCRIPTION OF THE PREFERRED EMBODIMENTS

Figure 2:
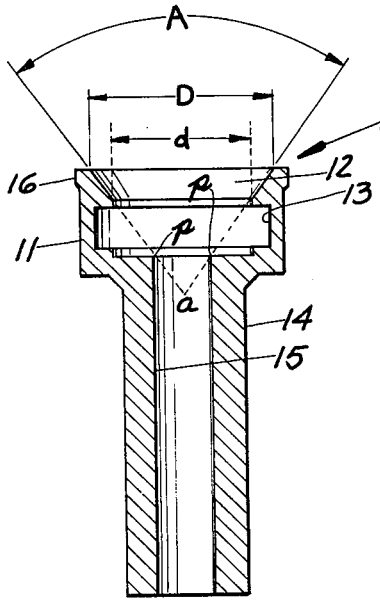
FIG. 2 is an enlarged vertical section view of a preferred tip member construction in accordance with the invention.

Referring to FIG. 2 of the drawings, which illustrate a tip member in accordance with the invention, the tip member has an annular body 11 the outer face of which is machined to define a truncated conical recess or seat 12 having a major diameter D and a minor diameter d beneath which lies an enlarged undercut annular cavity 13 which may have a diameter substantially equal to the major diameter D of the conical seat. At its opposite face the body 11 is provided with an integral elongated shank 14 having an axial bore 15 which opens at one end into the annular cavity 13. The dimensioning of the parts is preferably such that the angle A defining the conical wall surface of the seat 12, if projected inwardly to its apex a, will intersect the inner end of the axial bore 15 and the apex of the angle A will lie on the centerline of bore 15, as indicated by the dotted lines p. In a preferred embodiment the angle A is 70°, although it will be evident that the angle may be varied depending upon the configuration of the tip member. It is also preferred to provide the annular body 11 with an annular enlargement 16 adjacent its outer face to facilitate insertion of the tip member into the mold which forms the impact buttons, as will be explained hereinafter.

Figure 3:
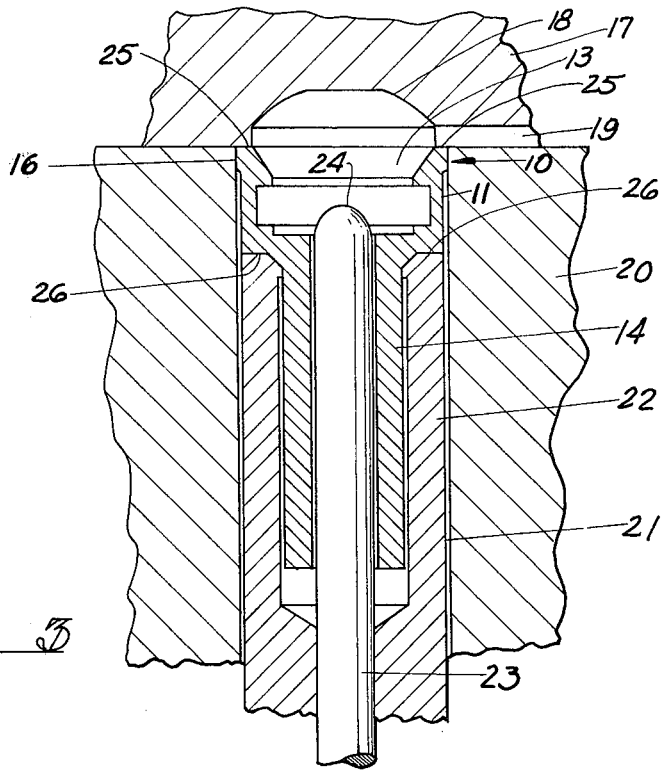
FIG. 3 is a vertical sectional view illustrating the manner in which an impact button is molded in situ to the tip member.

Referring now to FIG. 3, which illustrates the mold for forming the impact buttons, it comprises an upper mold member 17 having a mold cavity 18 configured to define the contour of the exposed portion of the impact button, the upper mold including a gate 19 through which the button forming elastomeric material is injected into the mold cavity 18. The upper mold member 17 is seated on a lower mold member 20 having a through bore 21 of a size to slidably receive a tip nest and ejector 22 having an upwardly projecting mandrel pin 23, the mandrel pin terminating at its upper end in a rounded nose 24. As will be apparent from FIG. 3, a tip member 10 may be seated in the lower mold with the mandrel pin projecting upwardly through the axial bore in the tip member. The annular enlargement 16 at the upper end of the tip member will be sized so that it may be lightly press fitted into the bore 21 of the lower mold member, whereas the annular body 11 will have a slightly smaller diameter, thereby permitting the tip member to be readily seated on the tip nest and ejector 22. Initially, the tip member will be positioned with the undersurface of enlargement 16 seated on the upper surface of the lower mold in the area immediately surrounding the bore 21. When the mold is closed, the upper mold member 17 forces the tip member 10 into the mold bore 21 by contact with the margin 25 surrounding the upper end of conical seat 12 so that the tip member comes in contact with tip nest 22 at its peripheral face 26. With this arrangement it is unnecessary to press fit the entire body of the tip member into the mold bore 21. However, the press fitted enlargement 16 will effectively serve to prevent flash material from enveloping the tip body during molding. It will be understood that the button forming elastomer will be injected into the mold cavity 18 through the gate 19, followed by cooling and solidification of the elastomer, or by heating of the elastomer to a thermoset material. Following the molding operation, the mold parts will be separated and the tip member ejected by means of the tip nest and ejector 22.

Figure 4:
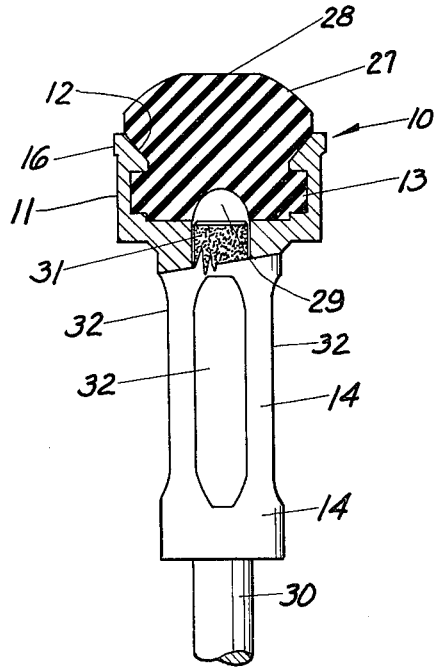
FIG. 4 is an enlarged elevational view with parts broken away illustrating one end of a finished pushrod in accordance with the invention.

FIG. 4 illustrates the finished tip member with the elastomer impact button 27 molded thereto. In accordance with the invention, the impact button will be firmly anchored to the tip member by reason of the undercut annular cavity 13 and reliance need not be placed on an adhesive bond between the impact button and the tip member. The configuration of the mold cavity is such that the impact button is provided with a centrally disposed flat surface 28 which preferably will have a diameter of approximately 30% to 40% of the outside or maximum diameter of the impact button. Such flat surface acts to reduce the amount of adjustment of the pushrods during burn-in and also serves to maintain a greater percentage of button height.

Figure 1:
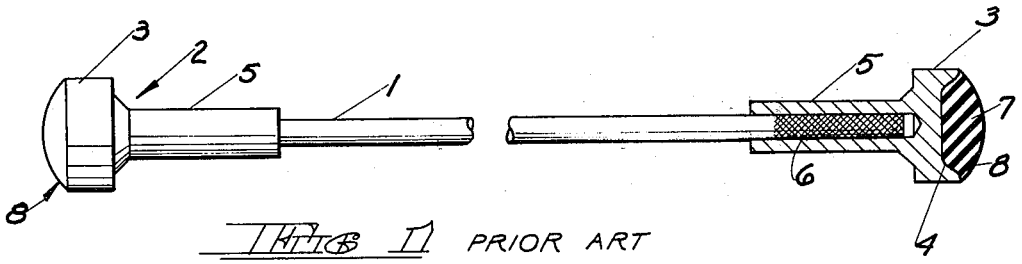
FIG 1 PRIOR ART
FIG. 1 is a plan view with parts broken away illustrating a typical prior art pushrod.

The impact button is also preferably provided with an indentation or dimple 29 centrally disposed in its undersurface, such dimple being formed by the nose 24 of mandrel pin 21 as an incident of the molding operation. The dimple 29 provides a void which can accommodate a decrease in the volume of the impact button due to elastic deformation. The dimple also coacts with the conical seat 12 to direct impact forces towards the centerline of the pushrod wire where such forces can be most effectively transferred to the pushrod wire and wire deflection minimized. It may be further noted that the relatively thick depth of the impact button 27, as compared with the relatively thin depth of the prior art impact button 7 shown in FIG. 1, provides reduced unit stresses within the button and lessens the extent to which it will be permanently deformed under load. The construction thus allows for a less severe transmission of the impact forces to the pushrod wires and hence acts to prevent wire breakage.

Wire breakage is also minimized by the manner in which the tip members are swaged to the pushrod wires. To this end, the axial bore 15 in the shank of the tip member will be sized to snuggly receive the pushrod wire 30 seen in FIG. 4. The pushrod wires are normally quite thin, having a diameter of about 0.02 inch, the wires being formed from spring temper stainless steel having a bright finish to facilitate sliding of the wires relative to the guide grooves in which they are mounted. Heretofore it has been customary to roughen the ends of the wires to provide a better grip by the swaged shanks of the tip members. A knurling tool has been used for this purpose. It has been found that aluminum oxide grit blasting while protecting the intermediate portion of the wire is far superior for obtaining a roughened surface suitable for swaging. A grit blasted roughened end of the pushrod wire 30 is indicated at 31. It is preferred that the roughened area be confined within the length of the shanks 14.

In accordance with the preferred embodiment of the invention, the stems of the tip members are swaged by at least three and preferably four swaging members spaced at angularly equal distances around the periphery of the shanks 14. The swaging members are configured to form flats 32, as seen in FIG. 4. It has been found that three or four equally spaced swaging members act to maintain the tip members concentric with the pushrod wires during swaging and, in use, there is no tendency for the impact forces to cause the tip members to deflect more frequently in any one direction.

The elastomeric material from which the impact buttons are molded does not constitute a limitation on the invention, although a preference is expressed for polyurethane resins having the required tensile strength, resistance to deformation under load, resistance to abrasion, and resistance to chemicals and the operating temperatures encountered during use. After molding, in order to obtain optimum properties from the elastomer, the molded tip members may be post cured in an oven, as will be understood by the worker in the art. Following curing the gate tails are cut and the tip members are then ready to be swaged into the pushrod wires.

Figure 5:
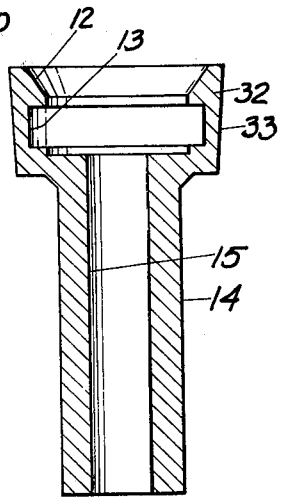
FIG. 5 is a vertical sectional view similar to FIG. 2 illustrating a modified tip member.

Modifications may be made in the invention without departing from its spirit and purpose. FIG. 5 illustrates a modified tip member configuration which is similar to FIG. 2 except that the annular body 32 of the tip member has a tapered annular wall surface 33, with the maximum diameter at the outermost end of the body, thereby eliminating the annular enlargement 16 of the tip member shown in FIG. 1. The maximum diameter of the annular body 32 will be such that it may be pressed fitted into the mold cavity, thereby achieving the desired tight fit.

Figure 6:
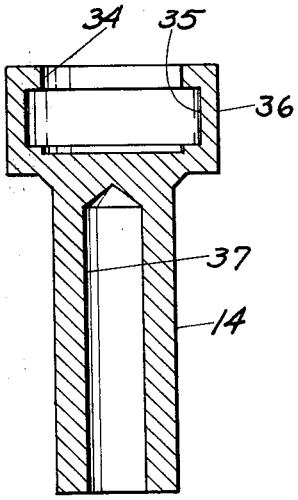
FIG. 6 is a vertical sectional view similar to FIGS. 2 and 5 illustrating a further modification of the tip member.

FIG. 6 illustrates a further modification of the tip member wherein the conical seat 12 of FIGS. 2 and 5 is replaced by a cylindrical seat 34 having a constant diameter which is smaller than the diameter of the underlying cavity 35. In addition, the tip body 36 has a uniform outer diameter and the axial bore 37 is a blind bore, terminating short of the cavity 35. While such arrangement does not possess all of the desirable design features of the embodiments of FIGS. 2 and 5, the construction is nonetheless effective to provide enhanced pushrod life as compared to pushrods of the prior art.

What is claimed is:

1. A pushrod for an impact printer comprising an elongated pushrod wire, a concentric tip member mounted on at least one end of said wire in axial alignment with the longitudinal axis of said pushrod wire, said tip member comprising an annular body having an outer end surface and an inner end surface, an elongated shank projecting outwardly from the inner end surface of said annular body, an axial bore in said shank for receiving an end of said pushrod wire, a seat-forming recess in the outer end surface of said annular body, said seat-forming recess comprises a conical surface having its largest diameter outermost, an undercut cavity in said body underlying and in communication with said seat-forming recess, and a molded in situ impact button seated in said recess and having an integral portion thereof filling said cavity, said impact button projecting outwardly from said recess and having an impact surface at its outermost end which is concentric with respect to the axis of said axial bore.

2. A pushrod claimed in claim 1 wherein said seat-forming recess defines an included angle of less than 90%.

3. The pushrod claimed in claim 1 wherein the axial bore in said shank is in communication with the cavity in said annular body.

4. The pushrod claimed in claim 3 including a recess between the undersurface of said impact button and the end of the pushrod wire in said axial bore.

5. The pushrod claimed in claim 1 wherein the impact surface of said impact button is flat and has a diameter of from about 30% to 40% of the maximum diameter of said impact button.

6. The pushrod claimed in claim 1 wherein the shank of said tip member is radially compressed at three or more angularly equal locations about its periphery to swage the shank to the wire.

7. The pushrod claimed in claim 10 wherein a portion of the pushrod wire received in the axial bore in said shank is grit blasted to roughen its surface.

8. A pushrod for an impact printer comprising an elongated pushrod wire, a concentric tip member mounted on each end of said wire in axial alignment with the longitudinal axis of said wire, each of said tip members comprising an annular body having an outer end surface and an inner end surface, an elongated shank projecting outwardly from the inner end surface of said body, an axial bore in said shank for receiving an end of said pushrod wire, a conical seat-forming recess in the outer end surface of said annular body, said conical recess having its largest diameter outermost, an annular cavity in said body underlying and in communication with said seat-forming recess, said annular cavity having a diameter greater than the smallest diameter of said conical recess, the axial bore in said shank opening into said annular cavity, and a molded in situ impact button seated in said recess and filling said annular cavity, said impact button having a semi-hemispherical portion projecting outwardly from said recess and terminating at its outermost end in an impact surface, said impact surface being concentric with respect to the axis of the axial bore in said shank.

9. The pushrod claimed in claim 8 wherein said impact surface comprises a flat circular surface having a diameter which is from about 30% to about 40% of the maximum diameter of said impact button.

10. The pushrod claimed in claim 9 including a recess between the undersurface of said impact button and the end of the pushrod wire in said axial bore.

11. The pushrod claimed in claim 10 wherein the shanks of the tip members are radially compressed at three or more angularly equal locations about their peripheries to swage the shanks of the tip members to the pushrod wire, the ends of the pushrod wire being grit blasted to roughen the portions thereof received in the axial bores in said shanks.

12. The pushrod claimed in claims 4 or 10 wherein said recess is formed in the undersurface of said impact button.

* * * * *